US007571816B2

(12) United States Patent
Osborne et al.

(10) Patent No.: US 7,571,816 B2
(45) Date of Patent: Aug. 11, 2009

(54) ADJUSTABLE COAL SCREENING APPARATUS

(75) Inventors: Lee-Ransome Osborne, Castlewood, VA (US); Samuel G. Sanders, Castlewood, VA (US)

(73) Assignee: Ceramic Technology, Inc., Cedar Bluff, VA (US)

( * ) Notice: Subject to any disclaimer, the term of this patent is extended or adjusted under 35 U.S.C. 154(b) by 0 days.

(21) Appl. No.: 11/374,166

(22) Filed: Mar. 14, 2006

(65) Prior Publication Data

US 2007/0215527 A1 Sep. 20, 2007

(51) Int. Cl.
*B07B 1/46* (2006.01)

(52) U.S. Cl. ..... 209/243; 209/240; 209/251

(58) Field of Classification Search ..... 209/404, 209/243, 251

See application file for complete search history.

(56) References Cited

U.S. PATENT DOCUMENTS 3,204,764 A * 9/1965 Prins ..... 209/18
5,133,396 A * 7/1992 Selak et al. ..... 156/361
6,575,304 B2 * 6/2003 Cudahy ..... 209/365.3
7,380,672 B2 * 6/2008 Fout et al. ..... 209/309
2004/0206673 A1 * 10/2004 Peresan ..... 209/268
2005/0242009 A1 * 11/2005 Padalino et al. ..... 210/86

OTHER PUBLICATIONS

Sieve Bends, dewatering, Feed Boxes and Screen Holders—Conn-Weld Industries. *Sieve Bends for the Process Industry; Design of the Gravity Sieve Bend*. http://www.conn-weld.com/sieve.htm. Sep. 22, 2006.

CRC-Model CR/Sb Sieve Bends. Engineered Products; Model CR/SB Sieve Bends. http://www.clinch.com/sieve.htm. © 2006 Clinch. Sep. 22, 2006.

VariSieve—Krebs Engineers. Products, VeriSieve: Basic Operating Principles of a Sieve Bend. http://www.krebs.com/products.php/product/29/VariSieve%AE. Sep. 22, 2006.

Norris Screen & Manufacturing: Printable Sieve Bend Data Sheet. http://www.norrisscreeen.com/nds/nds-sieve-bends.htm. Sep. 22, 2006.

* cited by examiner

*Primary Examiner*—Patrick H Mackey
*Assistant Examiner*—Kalyanavenkateshware Kumar
(74) *Attorney, Agent, or Firm*—Sughrue Mion, PLLC

(57) ABSTRACT

A screening and sorting assembly for coal particles includes a bin for receiving crushed coal. The bin is provided with a weir over which the coal particles are passed onto a pivoted screen assembly having a plurality of openings therethrough for sorting the coal particles. A cam arrangement is provided for varying the angle of the screening assembly relative to the horizontal to vary the speed of flow of the coal particles downwardly over the screening assembly.

14 Claims, 5 Drawing Sheets

SECTION A–A

ADJUSTABLE COAL SCREENING APPARATUS

BACKGROUND OF THE INVENTION

Subsequent to the mining of coal, the coal is subjected to a crushing operation. The crushed coal is then fed to a separating apparatus to remove the fines and to separate the coal particles according to size. The impact of the coal particles and the flow of the coal particles across the screen result in a very short lifespan for the metal feed screens.

SUMMARY OF THE INVENTION

The present invention provides a new and improved flat panel feed screen arrangement dewatering the coal particles and to separate partial flows to separate paths by means of an improved screen arrangement. The screen assembly according to the present invention eliminates impact damage to screens from oversized particle impact and will remove magnetized and other types of media from material streams to more efficiently classify the coal to market specifications.

The screen according to the present invention incorporates a new feed point approach onto a ceramic weir pocket dead bed as the material reverses flow onto the stainless steel screens. The velocity is slowed to allow the screen time to be sufficient for classifying the coal according to the openings of the screens. The discharge angle is evaluated and set as to the use in particle size classification allowing a flow at the slowest speed per minute to encourage particle classification.

These and other objects, advantages and details of the invention will be best understood by reference to the detailed description and the accompanying drawings appended hereto.

DETAILED DESCRIPTION OF THE INVENTION

Figure 1:
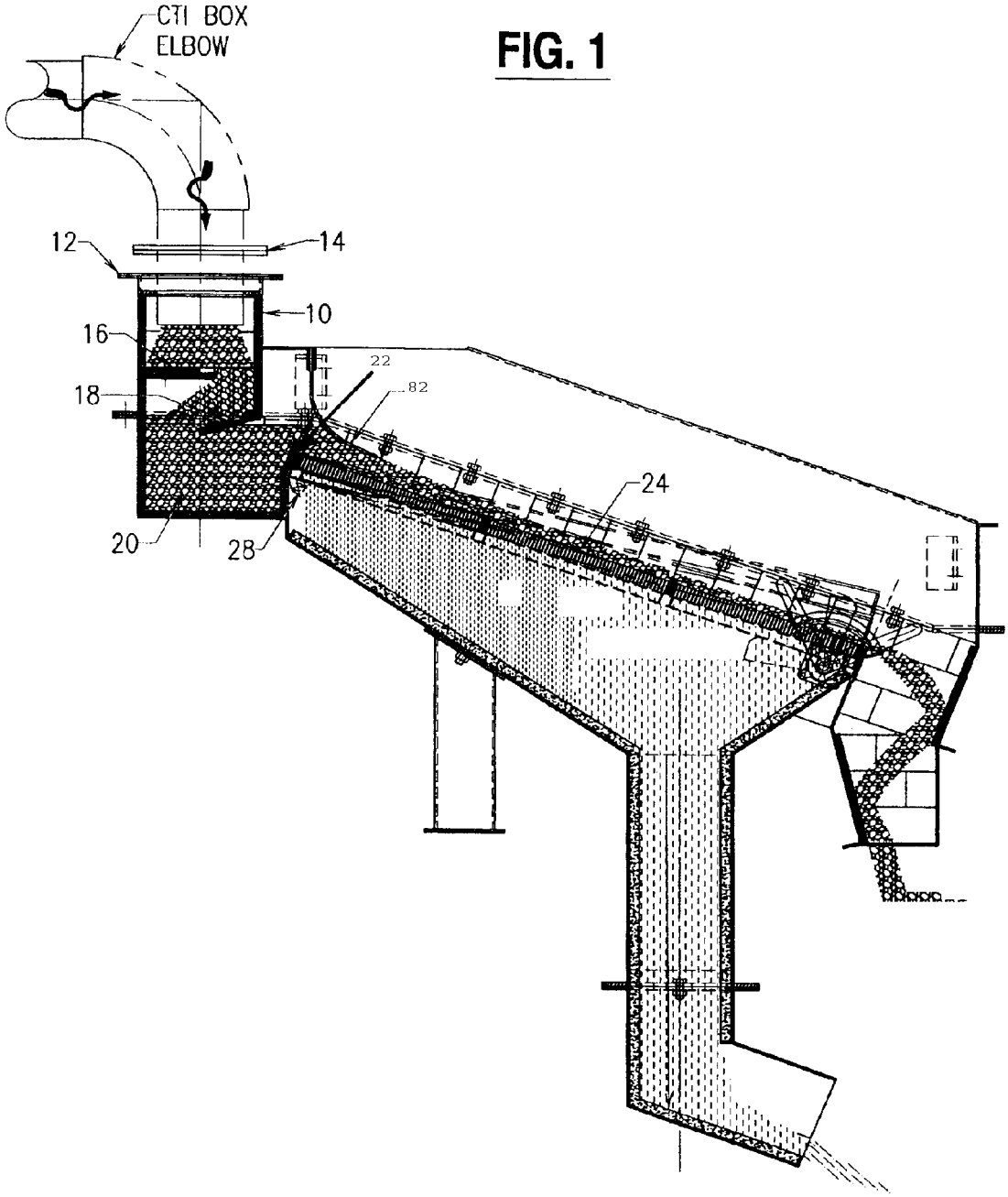
FIG. 1 is a side elevation of a coal feed and screening assemble according to the present invention with internal details shown in broken lines.

The coal feed and screening assembly as shown in FIG. 1 is comprised a supply storage and feeding tower having a top coal feed opening 12 as well as a side feed opening 14. The coal is then fed over the edge of a horizontal plate 16 onto an angular plate 18 which reduces the speed and impact of the coal as it is fed into the lower supply chamber 20. The coal then passes over the lip of a weir 22 onto the screening assembly 24. A curtain 82 hangs down at the portion of the screening assembly 24 where the coal is fed from the lower supply chamber. The curtain controls the flow of the coal that has passed over the lip of the weir 22.

Figure 3:
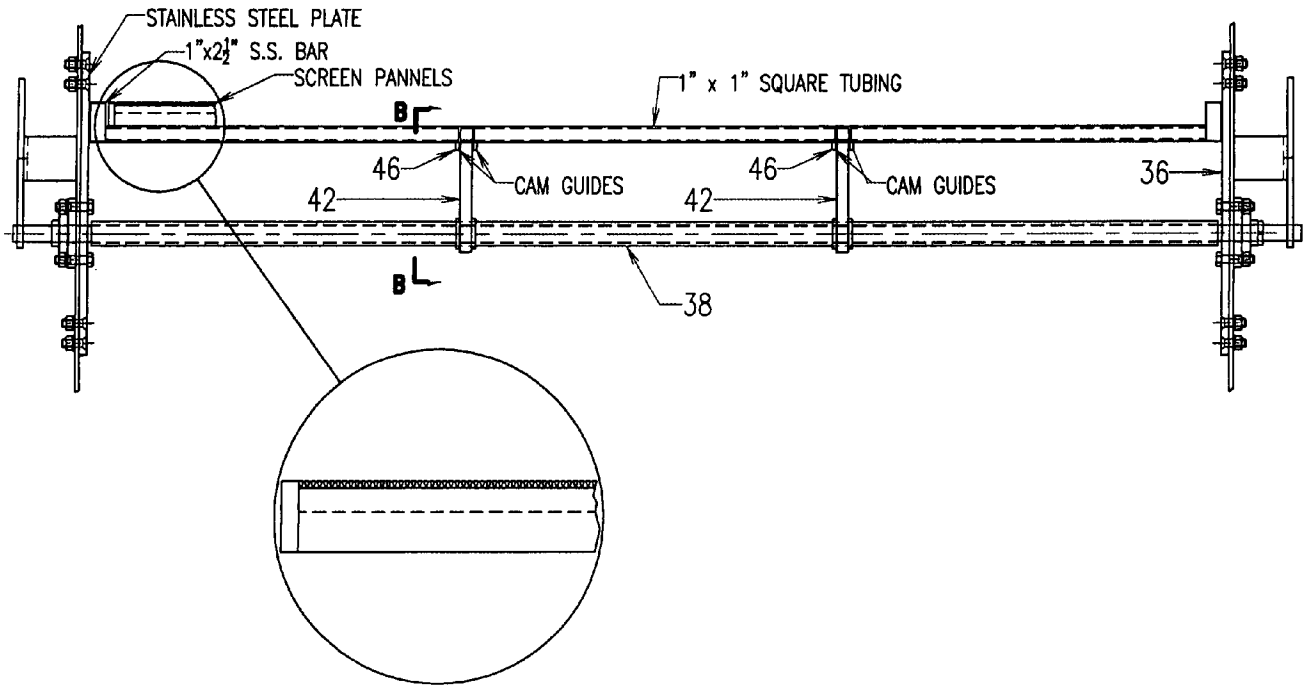
FIG. 3 is an end elevational view of the screening assembly with the adjustment means.
Figure 4:
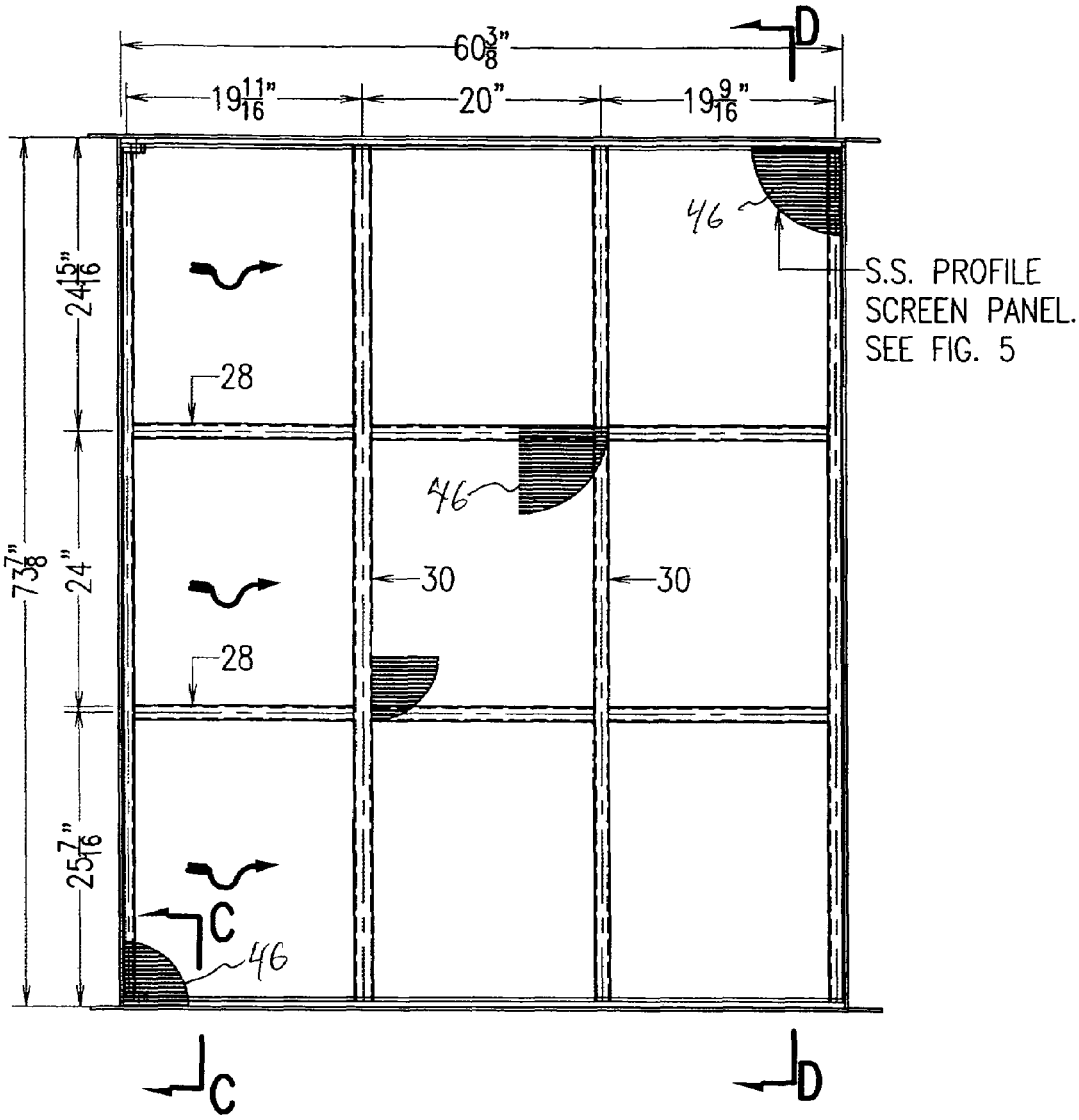
FIG. 4 is a top plan view of the screen assembly.
Figure 5A:
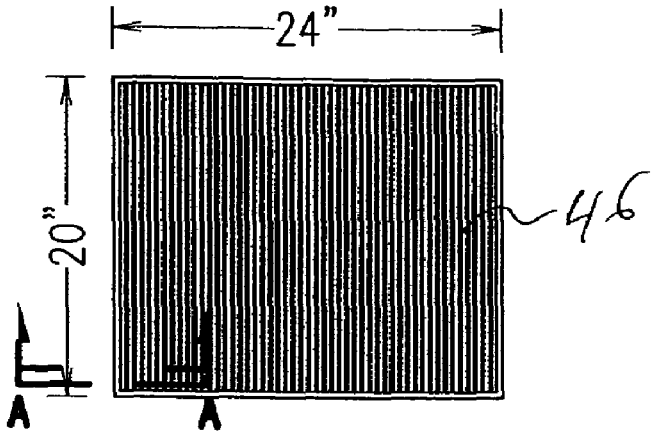
FIG. 5A is a detailed top plan view of a screen panel.
Figure 5B:
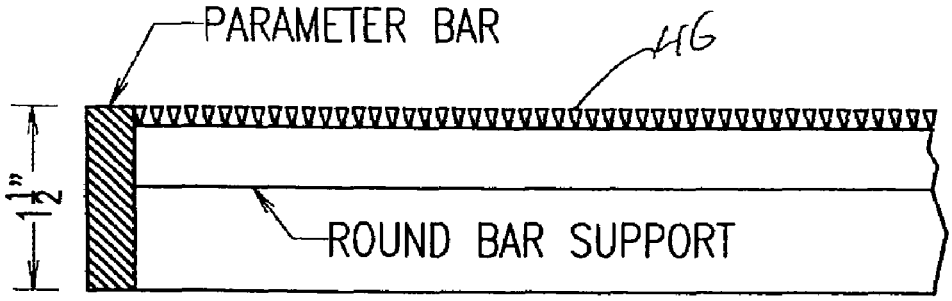
FIG. 5B is an enlarged partial sectional view of a screen panel taken along the line A-A in FIG. 5A.

The screening assembly 24 as shown in FIG. 3 is comprised of a frame 26 which is pivoted to the lip of the weir 22 by means of a pivot assembly 28. The frame 26 as shown in FIG. 4 is comprised of four sides connected each other to define a substantial square opening which is divided into the plurality of openings by means of cross frames 28 and 30 which define a plurality of openings. The screen panels 32 are supported in each opening defined by the supports 26, 28 and 30. Each of the screen panels 32 as shown in FIG. 5 is provided with a plurality of closely spaced apart steel rods 46 which permit a certain size coal particle to pass through. The plates can readily be interchanged with other plates having different size openings.

The speed of the flow of coal particles over the screens after passing over the weir 22 may be adjusted to improve the passage of the coal particles through the openings in the plates or screen panels 32.

Figure 2:
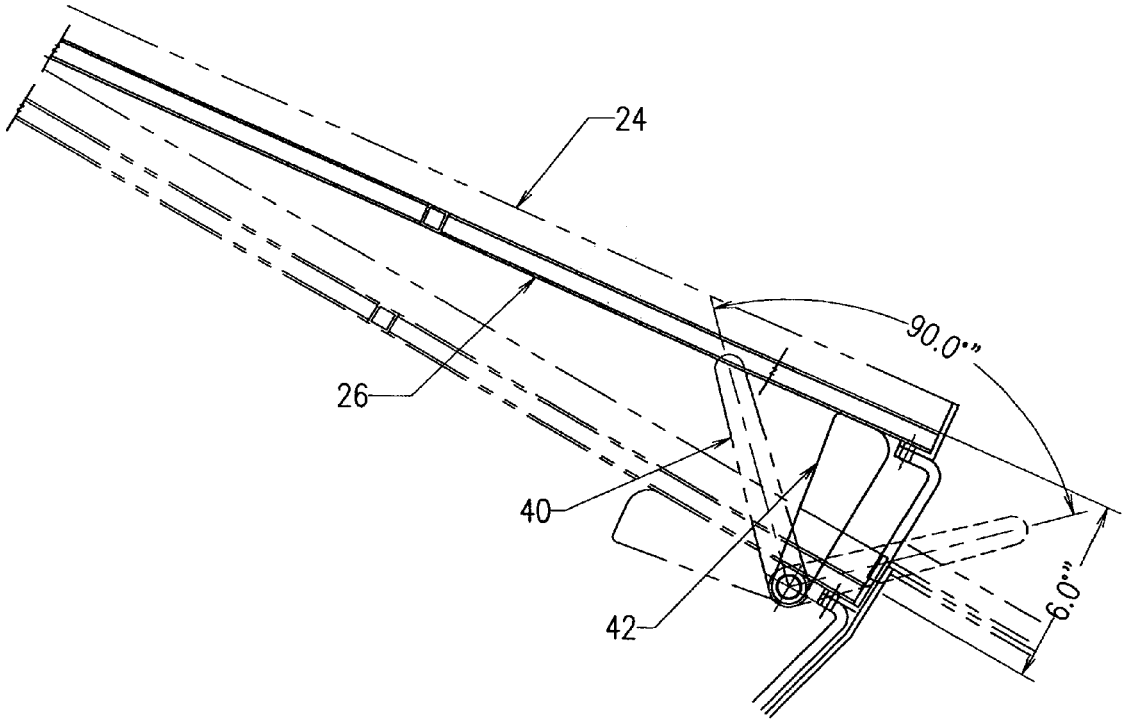
FIG. 2 is a side elevation view showing the adjustment arrangement for the screen assembly.

The screen assembly 24 is provided with a pair of steel side plates 34 and 36. A transverse shaft 38 is rotatably mounted in the side panels 34 and 36. An operating lever 40 is secured to one end of the shaft 38 outside the sidewall 34. A pair of cams 42 are mounted on the shaft 38 for rotation with the shaft. The uppermost ends of the cams 42 are guided between a pair of cam guides 46 which are mounted on a screen panel supporting frame 26. Upon rotation of the lever 40 the cams 42 will be rotated between the solid line position and the broken line position shown in FIG. 2. When the cams are in the solid line position the angle of the screen plates becomes closer to the horizontal to reduce the speed of flow of the coal particles downwardly over the screen panels. When the cams 42 are moved to broken line position as shown in FIG. 2, the angle of the screen panels relative to the horizontal is increased thereby causing an increase in the speed of the coal articles over the screen panels. Thus the wear and tear on the screen panels can be reduced by slowing the downward speed of the coal particles.

While a particular embodiment of the present invention has been described and shown above, it will be understood that the invention is not limited thereto since modifications may be made with respect to the screen assembly in accordance with the present invention. It is contemplated therefore, by the appended claims, to cover any such modifications that fall within the true spirit and scope of the invention.

What is claimed is:

1. A method for feeding and classifying mineral particles, comprising:

feeding mineral particles downward into a particle storage and distribution bin, wherein a flow of the mineral particles is reversed before entering the particle storage and distribution bin;

passing the mineral particles over a weir of the particle storage and distribution bin and onto a particle screening assembly, wherein the particle screening assembly is inclined;

separating the mineral particles according to size by allowing larger particles to flow downward over the particle screening assembly into a larger particle passage and by passing smaller particles through the screen assembly.

2. The method for feeding and classifying mineral particles set forth in claim 1, wherein said screening assembly is comprised of a rectangular frame having a plurality of openings with a plurality of screen panels having openings therein removably mounted on the framework over each of said openings.

3. The method for feeding and classifying mineral particles set forth in claim 1, further comprising varying an angle of the screening assembly relative to the horizontal to adjust the flow of the mineral particles over the screening assembly.

4. The method for feeding and classifying mineral particles set forth in claim 3, wherein the angle of the screening assembly is adjusted by a cam which is pivotably mounted in a down spout below said screen for engaging said screen to vary the angle of the screen relative to the horizontal.

5. The method for feeding and classifying mineral particles set forth in claim 2, wherein each screen panel is comprised of a rectangular frame and a plurality of closely spaced apart parallel rods.

6. The method for feeding and classifying mineral particles set forth in claim 2, wherein a plurality of openings are provided in a lengthwise and widthwise direction of the rectangular frame.

7. The method for feeding and classifying mineral particles set forth in claim 2, further comprising replacing the screen panels with different screen panels having a different distance between the parallel rods to allow a different size of particle to pass through.

8. The method for feeding and classifying mineral particles set forth in claim 1, wherein the flow of mineral particles is reversed by:

feeding the mineral particles onto an angular plate above the particle storage and distribution bin before they are fed into the particle storage and distribution bin, wherein the angular plate is provided above the particle storage and distribution bin.

9. The method for feeding and classifying mineral particles set forth in claim 8, wherein the flow of mineral particles is also reversed by:

feeding the mineral particles over an edge of a horizontal plate onto the angular plate before the mineral particles are fed into the particle storage and distribution bin.

10. The method for feeding and classifying mineral particles set forth in claim 1, wherein the mineral particles are coal particles.

11. The method for feeding and classifying mineral particles set forth in claim 9, wherein the mineral particles are coal particles.

12. The method for feeding and classifying mineral particles set forth in claim in claim 1, wherein the particle storage and distribution bin is ceramic.

13. The method for feeding and classifying mineral particles set forth in claim 9, wherein the flow of mineral particles is also reversed by:

feeding the mineral particles against a vertical wall after the mineral particles are fed over an edge of a horizontal plate and before the mineral particles are fed onto the angular plate.

14. The method for feeding and classifying mineral particles set forth in claim 13, wherein the angular plate and the particle screening assembly are inclined in opposite directions.

* * * * *